US006397643B1

(12) United States Patent
Chang et al.

(10) Patent No.: US 6,397,643 B1
(45) Date of Patent: Jun. 4, 2002

(54) SUSPENSION APPARATUS OF WASHING MACHINE

(75) Inventors: Jae Won Chang; Jin Sang Hwang, both of Kyungki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/482,880

(22) Filed: Jan. 14, 2000

(30) Foreign Application Priority Data

Jun. 1, 1999 (KR) ..... 99-19967

(51) Int. Cl.[7] ..... D06F 37/24
(52) U.S. Cl. ..... 68/23.3; 68/23.1; 68/23.2
(58) Field of Search ..... 68/23.3, 23.1, 68/23.2

(56) References Cited

U.S. PATENT DOCUMENTS

| | | | | | |
|---|---|---|---|---|---|
| 3,703,091 | A | * | 11/1972 | Steele | 68/23.1 |
| 4,729,458 | A | * | 3/1988 | Bauer et al. | 68/23.1 |
| 4,867,317 | A | * | 9/1989 | Wildeman et al. | |
| 5,117,659 | A | * | 6/1992 | Sharp et al. | 68/23.3 |
| 5,606,879 | A | * | 3/1997 | Frolicher et al. | 68/23.3 |
| 5,946,946 | A | * | 9/1999 | Sharp et al. | 68/23.1 |
| 6,247,687 | B1 | * | 6/2001 | Jensen et al. | |

FOREIGN PATENT DOCUMENTS

| | | | | |
|---|---|---|---|---|
| DE | 1287037 | * | 1/1969 | 68/23.1 |
| JP | 52-54274 | * | 5/1977 | 68/23.2 |
| JP | 2-198592 | * | 8/1990 | 68/23.3 |

* cited by examiner

*Primary Examiner*—Frankie L. Stinson

(57) ABSTRACT

A suspension apparatus of a washing machine which supports a washing tub in a suspended state in a casing of the washing machine is disclosed. The suspension apparatus includes suspension rods supporting the washing tub in the casing in a suspended state, damper bases installed at the lower ends of the suspension rods, damping force changing members fitted around the suspension rods so as to be compressed according to the variations in load of the washing tub and change the damping force, and elastic members installed between the damping force changing members and the damper bases. Since the damping force of the suspension apparatus is changed according to a washing load generated by the washing tub during the operation of the washing machine, vibrations and noises of the washing tub can be minimized.

6 Claims, 9 Drawing Sheets

SUSPENSION APPARATUS OF WASHING MACHINE

BACKGROUND OF THE INVENTION

1. Field of the Invention

The present invention relates to a washing machine for washing laundry such as clothes, and more particularly, to a suspension apparatus of a washing machine which makes a washing tub suspended in a casing of the washing machine so as to minimize vibrations and noises generated when the washing machine is operated.

2. Description of the Related Art

In general, automatic washing machines for washing clothes by using agitated water currents may be classified into various types of washing machines depending on the driving system thereof or the type of a pulsator.

FIG. 1 is a vertical sectional view illustrating the internal structure of a conventional directly coupled motor type washing machine, and FIG. 2 is a vertical sectional view illustrating the internal structure of a conventional clutch type washing machine employing a pulsator.

First, the directly coupled motor type washing machine as shown in FIG. 1 is rotationally driven according to the operation of a motor 15 since an inner drum 12 is directly connected to the driving shaft 14 of the motor 15, a washing tub comprised of the inner drum 12 and an outer drum 13 is suspended by four suspension rods 16 in a casing 11 of the washing machine, and the motor 15 is positioned below the outer drum 13.

The driving shaft 14 of the motor 15 is connected to the inner drum 12 through the outer drum 13, and while the inner drum 12 rotates according to the operation of the motor 15, washing operation is performed.

On the other hand, in the clutch type washing machine, a pulsator 29 attached to the bottom surface of an inner drum 22 is rotated by a driving shaft 24 connected to a motor 25, and a clutch 28 is provided at the driving shaft 24 so that rotational power transmission can be connected or disconnected.

That is, the motor 25 is provided below an outer drum 23 of a washing tub, the motor 25 is connected to the driving shaft 24 via a pulley and a belt 27, and the clutch 28 is installed in the middle of the driving shaft 24 so that the rotational power transmission can be connected or disconnected.

In addition, while in the directly coupled motor type washing machine the motor directly drives the inner drum, the driving shaft 24 is connected to the pulsator 29 provided in the inner drum 22 as a rotating body, and washing operation is performed as the pulsator 29 is driven to rotate in a state in which the inner drum 22 does not rotate.

The outer drum 23 is connected to a casing 21 of the washing machine by four suspension rods 26 in a suspended manner as in the directly coupled motor type washing machine.

As described above, in both the directly coupled motor type washing machine and the clutch type washing machine, the inner and outer drums in which wash operation is performed are connected in the casing of the washing by the suspension rods as shown in FIG. 3. Referring to FIGS. 1 and 3, a suspension member 16*a* is installed at the upper end of the suspension rod 16 or 26 and fitted to a bracket 11*a* of the casing of the washing machine, and a damping force changing means 17 is installed at the lower end of the suspension rod 16 or 26 and performs damping function during the operation of the washing machine while supporting a bracket 13*a* of the outer drum.

In particular, the damping force changing means 17 is provided with a damper base 17*a* of a flange shape at the lower end of the suspension rod 16 as shown in FIG. 3, a damper spring 17*b* is disposed on the upper side of the damper base 17*a*, and a damper cap 17*c* which supports the outer drum 13 is capped over the damper spring 17*b*.

Therefore, the load generated from the inner and outer drums is transferred to the damper spring 17*b* via the damper cap 17*c*, and at this time the damper spring 17*b* does buffering function while being supported by the suspension rod 16.

Since, the distribution of laundry is not symmetrical with respect to the rotating shaft at the early stage of an extraction phase, eccentric load occurs in the washing tub, and accordingly vibrations and noises may be severely generated.

To form a damping force for buffering such vibrations is an important role of the damping force changing means 17. That is, the damping force converts kinetic energy into thermal energy, etc. to decrease the amplitude of the vibrations, and is, in the damping force changing means 17, generated by a friction force ++++between the damper base 17*a* and the damper cap 17*c* and the flow of air into or out of the damping force changing means 17.

However, there is a problem in which when the conventional suspension apparatus employing the suspension rods 16 as described above is designed to have a greater damping force so as to suppress abnormal vibrations due to eccentric load generated at the early stage of an extraction phase, the amplitudes of noises become larger during the normal operation of the washing machine, and when the suspension apparatus is designed to have a lesser damping force so as to decrease the amplitudes of noises generated during the normal operation, excessive vibrations are generated at the early stage of the extraction phase and accordingly walking phenomena of the washing machine may occur.

Consequently, unless a damping force which satisfies the characteristics required during the early stage of the extraction phase and during the normal washing operation is formed, most portions of the vibrational forces generated at the inner and outer drums 12 and 13 are transferred to the casing 11 of the washing machine via the suspension rods 16, the amplitude of the vibrations of the casing 11 is more increased by the components of the transferred vibrational forces which are near to the resonant frequency of the casing 11. Therefore, the suspension rods 16 and the outer drum 13 are also vibrated, and accordingly more noises are generated when the washing machine is operated.

SUMMARY OF THE INVENTION

To solve the above problems, it is an objective of the present invention to provide a suspension apparatus of a washing machine which is capable of minimizing vibrations and noises by changing the structure of a damping force changing means so that the damping force of the damping force changing means can vary with acting load generated when the washing machine is operated.

To achieve the above objective, there is provided a suspension apparatus of a washing machine comprising:

suspension rods the upper portions of which are connected to a casing of the washing machine and the lower portions of which are connected to a washing tub so that the washing tub can be supported in the casing in a suspended state;

damper bases installed at the respective lower ends of the suspension rods;

damping force changing means fitted around the respective suspension rods and positioned above the respective damper bases, so as to be compressed according to the variations in load of the washing tub and change the damping force generated when contacting the respective suspension rods; and elastic means installed between the damping force changing means and the damper bases, respectively, so as to do buffering action, and, in addition, providing compression forces for the damping force changing means, respectively.

BRIEF DESCRIPTION OF THE DRAWINGS

The above objective and advantage of the present invention will become more apparent by describing in detail preferred embodiments thereof with reference to the attached drawings in which.

DESCRIPTION OF THE PREFERRED EMBODIMENTS

Figure 1:
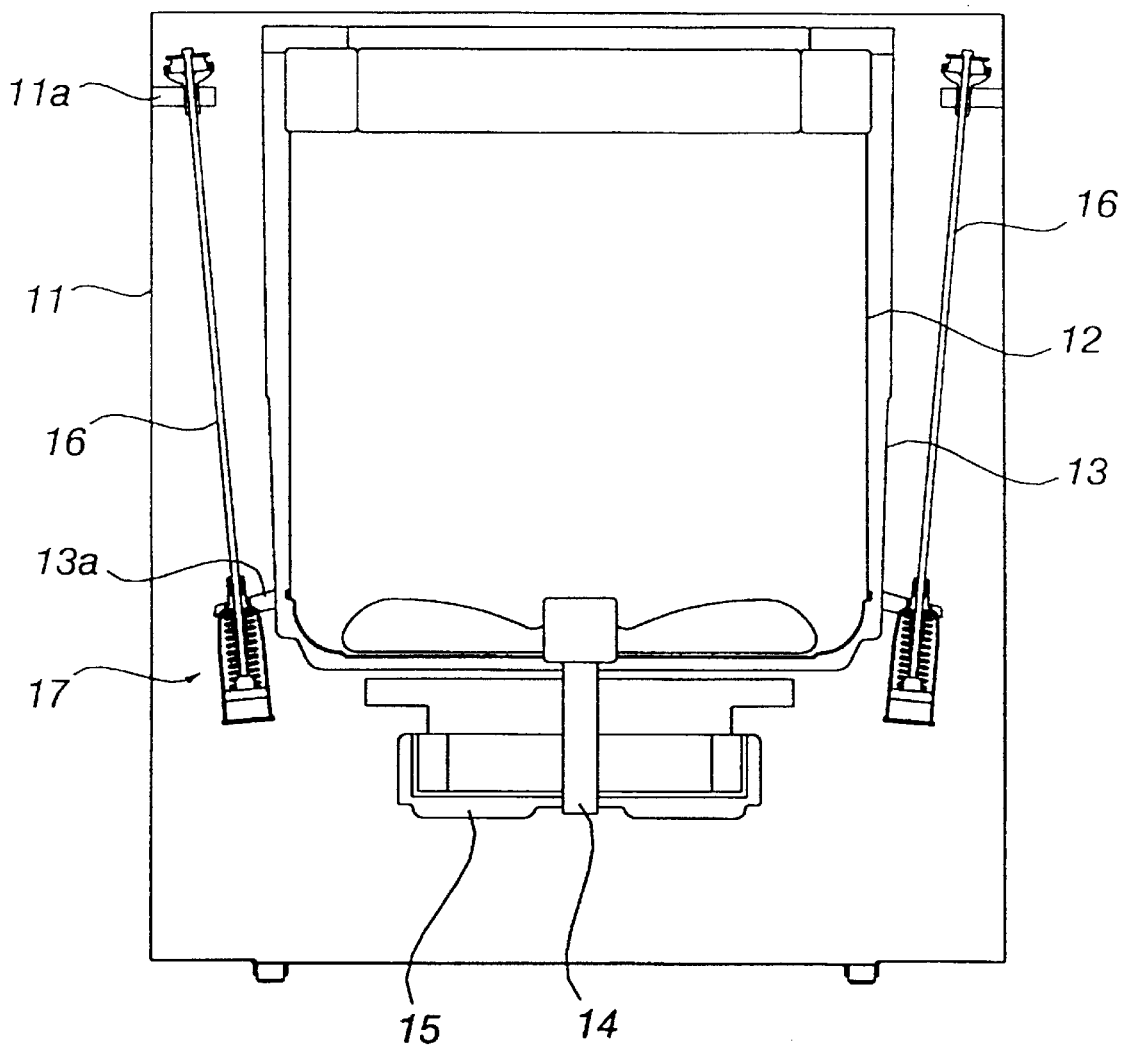
FIG.1 (Prior Art)
FIG. 1 is a vertical sectional view illustrating the internal structure of a directly coupled motor type washing machine provided with a conventional suspension apparatus.
Figure 2:
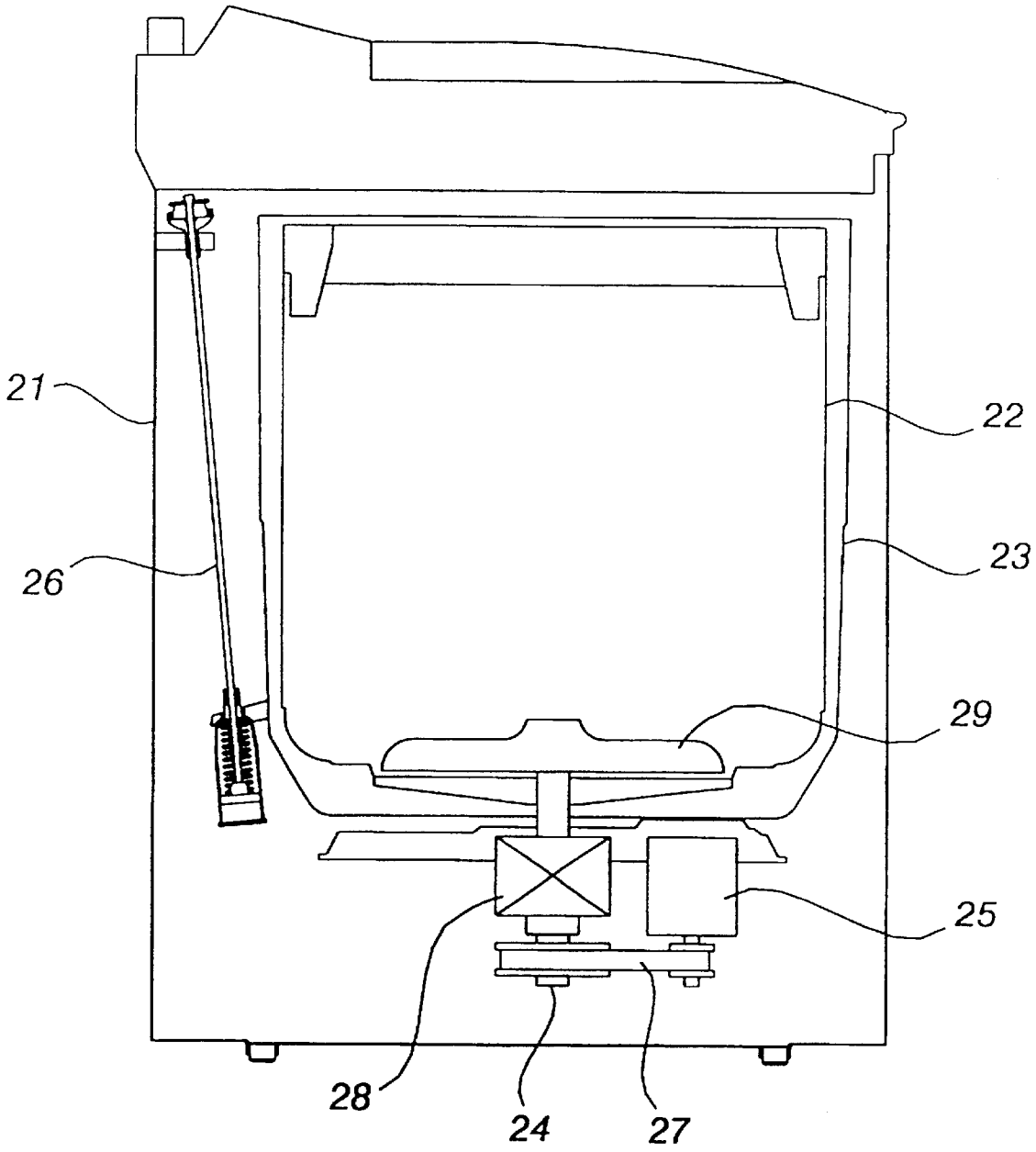
FIG.2(Prior Art)
FIG. 2 is a vertical sectional view illustrating the internal structure of a clutch type washing machine provided with a conventional suspension apparatus.
Figure 3:
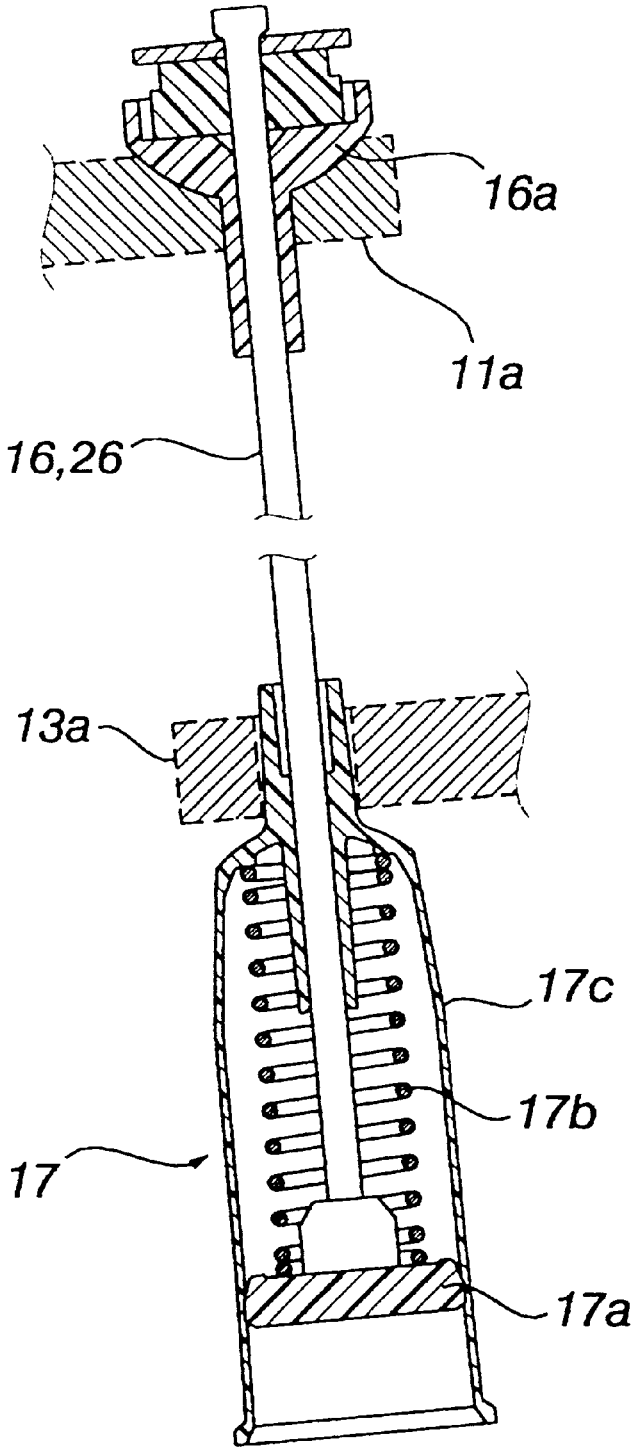
FIG.3(Prior Art)
FIG. 3 is a vertical sectional view illustrating a conventional suspension apparatus.
Figure 4:
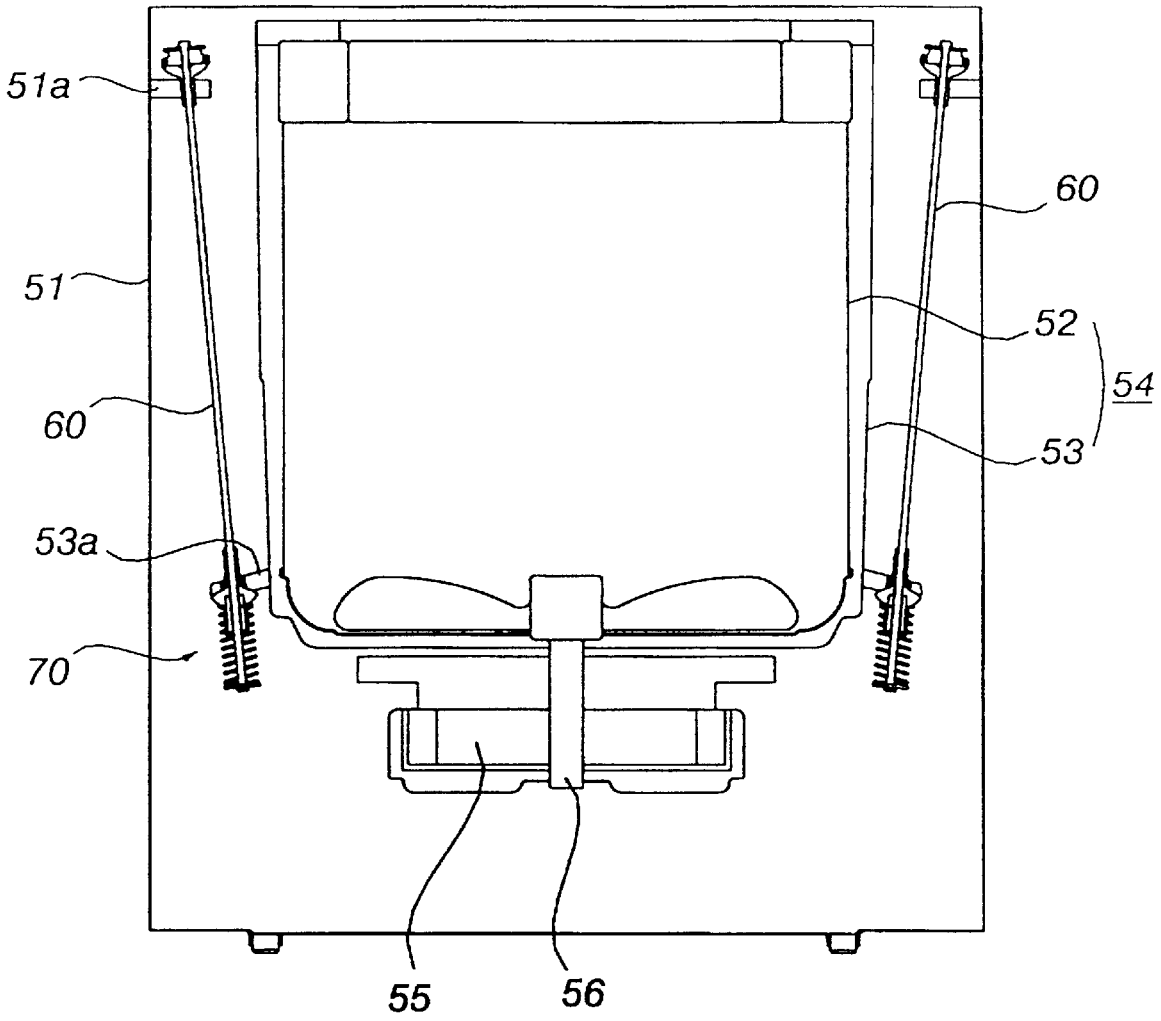
FIG. 4 is a vertical sectional view illustrating the internal structure of a washing machine provided with a suspension apparatus according to the present invention.

FIG. 4 is a vertical sectional view illustrating the internal structure of a directly coupled motor type washing machine provided with a suspension apparatus according to the present invention.

Referring to FIG. 4, a washing tub 54 comprised of an inner drum 52 and an outer drum 53 is supported in a suspended state by four suspension rods 60 in a casing 51 of the washing machine. In addition, a motor 55 is installed below the outer drum 53, and the driving shaft 56 of the motor 55 is connected to the inner drum 52 through the outer drum 53 and can rotate the inner drum 52.

The suspension rod 60 is formed in an elongated rod shape, and the upper end portion thereof is connected to a bracket 51*a* fixed to an upper portion of the casing 51 of the washing machine and the lower portion thereof is connected to a bracket 53*a* fixed to the outer drum 53.

Further, a damping force changing means 70 is installed at the lower end of the suspension rod 60, and as the damping force thereof vary with washing load change, the damping force changing means 70 gives buffering action to the washing tub 54.

Figure 5:
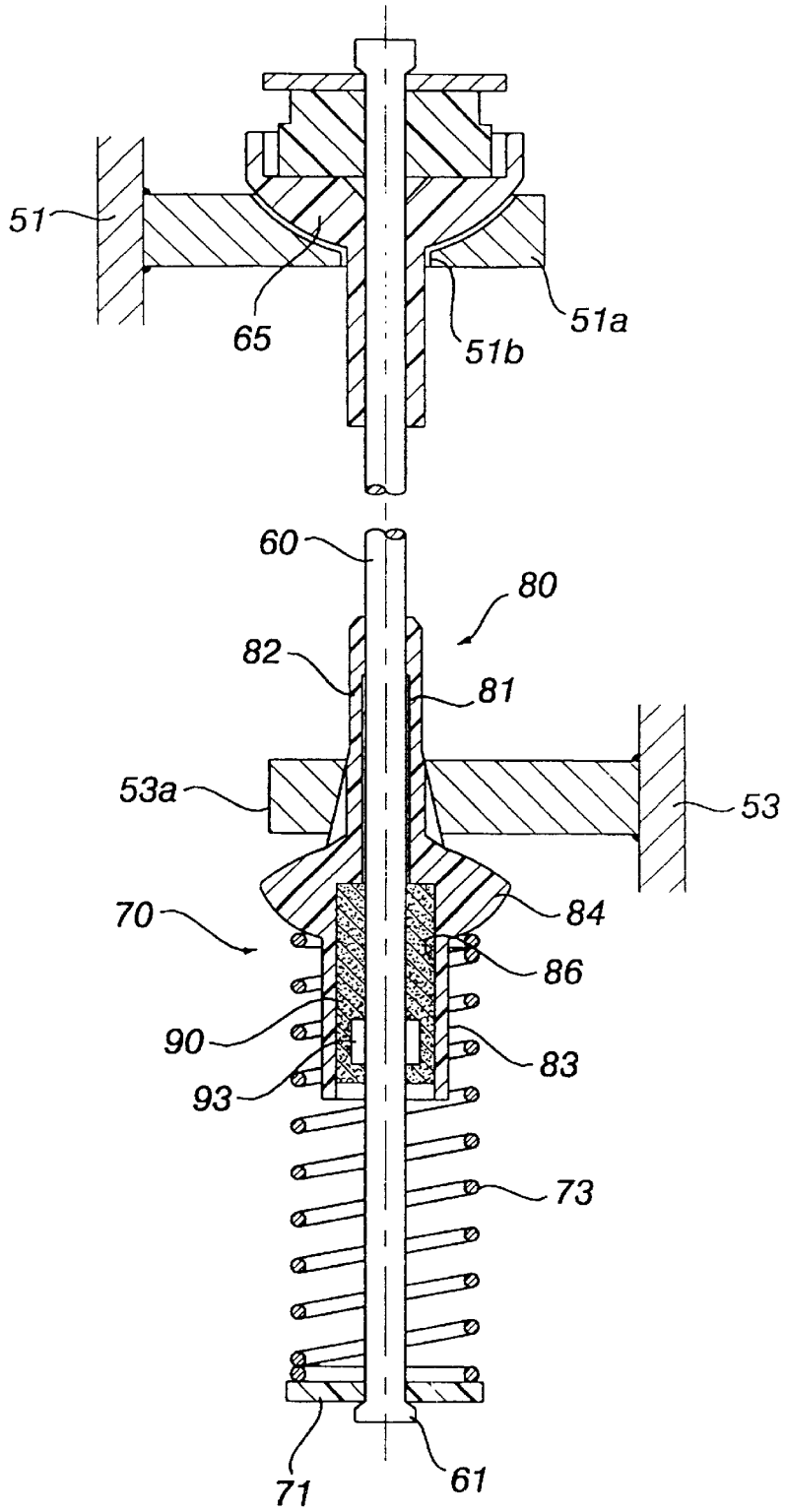
FIG. 5 is a vertical sectional view illustrating a suspension apparatus according to the present invention.

FIG. 5 is a detailed vertical sectional view illustrating the suspension rod 60 and the damping force changing means 70.

Referring to FIG. 5, a suspension member 65 is fitted to the upper end portion of the suspension rod 60, a bracket 51*a* provided with a hole 51*b* is fixed to the casing 51 of the washing machine. The upper portion of the suspension rod 60 is inserted through the bracket 51*a* in a state in which the suspension member 65 of the suspension rod 60 is hung by the hole 51*b*, and the damping force changing means 70 is installed at the lower portion of the suspension rod 60 and is connected to the bracket 53*a* fixed to the outer drum 53.

A damper base 71 of a wash shape is inserted at the lower end 61 of the suspension rod 60, and the lower end 61 of the suspension rod 60 is expanded in radial directions so that the damper base 71 cannot escape.

A damper spring 73 fitted around the suspension rod 60 is disposed on the damper base 71, and a supporting member 80 is disposed on the damper spring 73.

A hole 81 is formed through the center portion of the supporting member 80, and the supporting member 80 is fitted around the suspension rod 60 disposed between the bracket 53*a* of the outer drum 53 and the damper spring 73 so as to be movalble along the suspension rod 60 and supports the washing tub 54 by supporting the bracket 53*a*.

A friction member 90 is installed in a bore 86 of the supporting member 80 so that the friction member 90 can generate a friction force while contacting the suspension rod 60.

The supporting member 80 and the friction member 90 as described above are installed so that the friction force due to the contact with the suspension rod 60 can vary with change in vertical load generated between the outer drum 53 and the damper spring 73 during the operation of the washing machine.

Figure 6A:
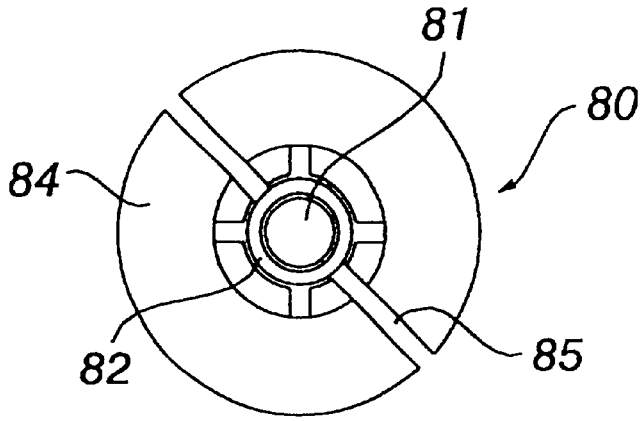
FIG. 6A is a plan view illustrating a supporting member which is an essential part of the present invention.
Figure 6B:
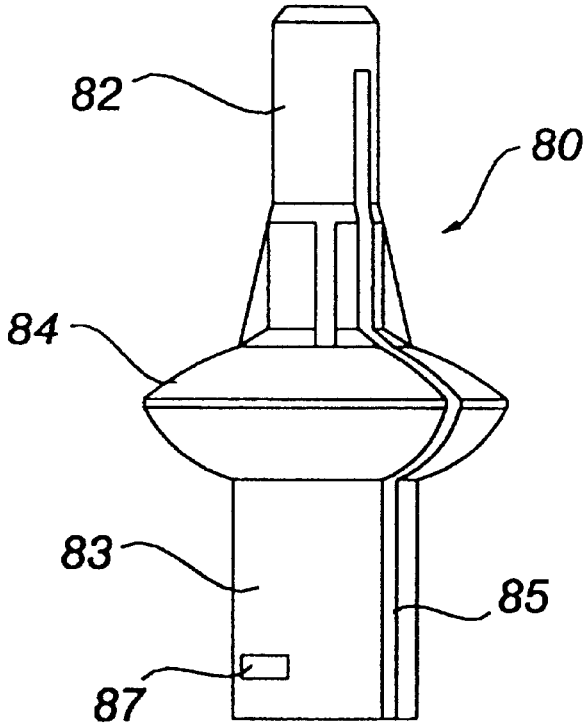
FIG. 6B is a front view illustrating the supporting member shown FIG. 6A.
Figure 6C:
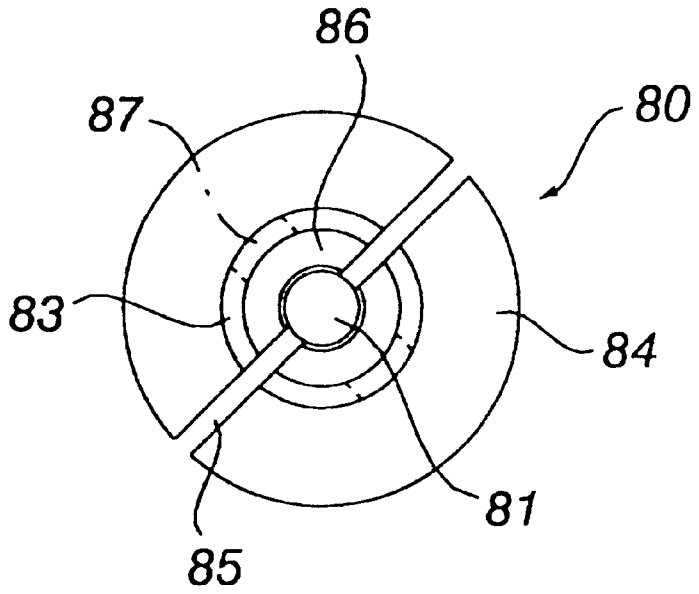
FIG. 6C is a bottom view illustrating the supporting member shown FIGS. 6A and 6B.

FIGS. 6A, 6B and 6C are detailed plan, front and bottom views illustrating the supporting member 80.

Referring to FIGS. 6A, 6B and 6C, the supporting member 80 is formed with a bracket-fitted portion 82, a slopingly surfaced portion 84, and a spring-fitted portion 83.

The bracket-fitted portion 82 and the spring-fitted portion 83 are formed to project in corresponding cylindrical shapes at the upside and downside of the slopingly surfaced portion 84, and inserted into the bracket 53*a* of the outer drum 53 and the damper spring 73, respectively.

In the supporting member 80, a cutout portion 85 is formed from the lower end of the spring-fitted portion 83 to a predetermined height of the bracket-fitted portion 82, and a bore 86 is formed in the slopingly surfaced portion 84 and the spring-fitted portion 83 so that the friction member 90 can be inserted into the bore 86 as shown in FIG. 5.

The slopingly surfaced portion 84 is projected in radial directions, and serves to convert a vertical compressional force between the bracket 53*a* of the outer drum 53 and the damper spring 73 into a horizontal compressional force.

Since the upper and lower surfaces of the slopingly surfaced portion 84 are formed with sloping surfaces and the thickness of the slopingly surfaced portion 84 becomes gradually thicker from the outer portion to the center portion thereof, the slopingly surfaced portion 84 can be contracted inward due to the cutout portion 85 when a compressional force is provided by the damper spring 73.

Figure 7A:
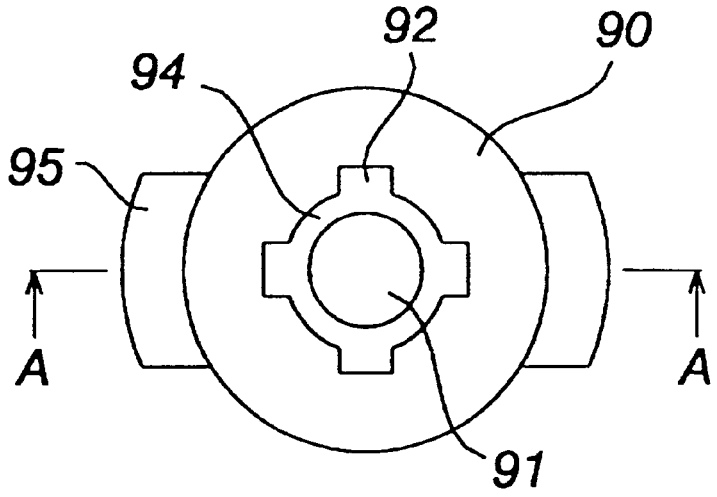
FIG. 7A is a plan view illustrating one embodiment of a friction member which is an essential part of the present invention.

FIG. 7A is a plan view illustrating the friction member 90 which is inserted into the bore 86 of the supporting member 80 as described above, and FIG. 7B is a sectional view taken along line A—A of FIG. 7A.

Figure 7B:
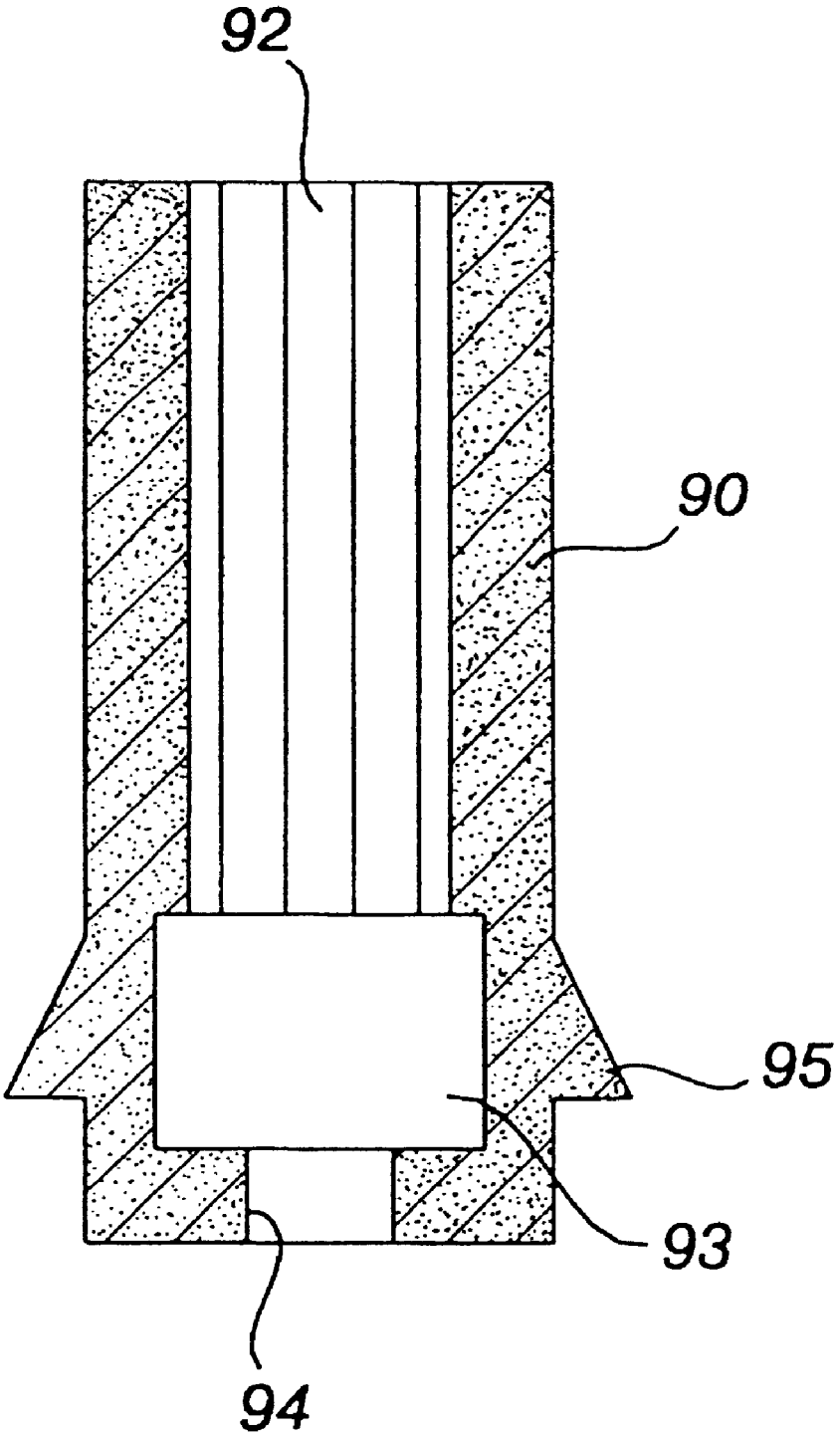
FIG. 7B is a sectional view taken along line A—A of FIG. 7A.

Referring FIGS. 7A and 7B, it is preferable that the friction member 90 is formed in a cylindrical shape so as to be installed between the suspension rod 60 and the supporting member 80, and is made of a rubber material which is easily deformed by a compressional force and easily creates a friction force.

In addition, it is preferable that a lubricant is injected to the inner surface of the friction member 90. Since when the lubricant is not injected thereto, it is difficult to effectively cause variation in a damping force to occur according to the increase or decrease of washing load due to excessive dry friction force which may occur between the friction member 90 and the suspension rod 60, it is preferable to form a proper friction force by injecting a lubricant such as grease to the inner surface of the friction member 90.

A plurality of guide grooves 92 are vertically formed at the surface of a hole 91 formed in the friction member 90 so that the lubricant can be smoothly supplied to the hole 91. Of course, it is preferable that the guide grooves 92 are symmetrically disposed so that the friction member 90 can form a balanced friction force when contacting the suspension rod 60.

A lubricant storing recess 93 is formed at the lower portion of the hole 91 in a circumferential direction so that the lubricant can be contained therein, and an O-ring portion 94 which serves as an O-ring is formed below the lubricant storing recess 93 by forming the inner diameter thereof to be relatively small so that the lubricant cannot leak.

As long as an inwardly compressing force is continuously maintained at the supporting member 80 by the bracket 53*a* of the outer drum 53 and damper spring 73 even though as the friction member 90 contacts the suspending rod 60, the contacting surface thereof is abraded to some extent, the friction member 90 can continue to form a friction force.

In addition as shown in FIGS. 6B, 6C, 7A and 7B, two projections 95 are formed at outer sides of the friction member 90 so that the friction forming member 90 can be easily fitted into the inside of the supporting member 80, and fitting holes 87 are formed at the supporting member 80 so that the projections 95 can be fitted into the corresponding fitting holes 87.

Figure 8:
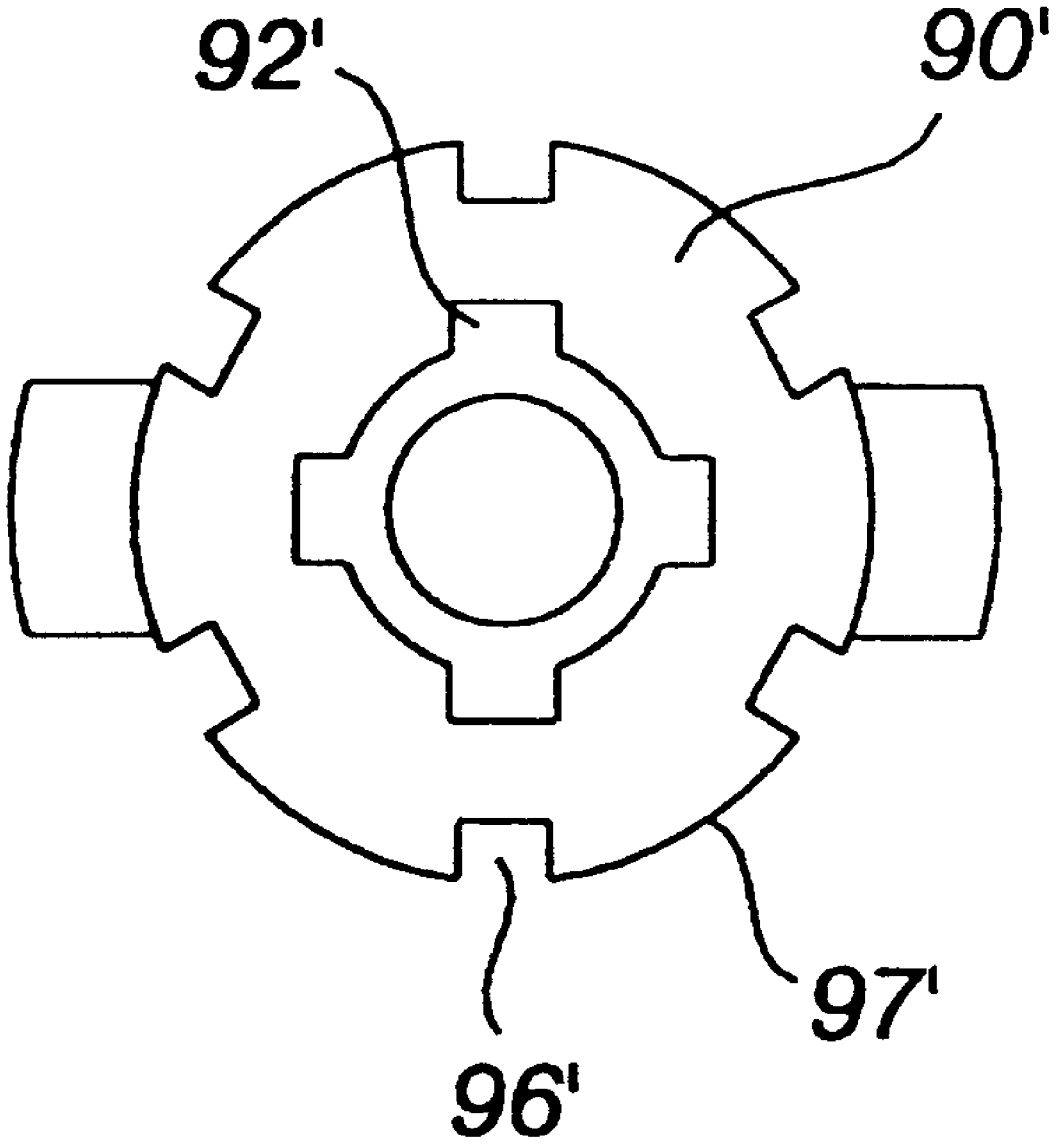
FIG. 8 is a plan view illustrating another embodiment of a friction member of the present invention.

FIG. 8 shows a plan view illustrating another embodiment of a friction member.

Referring to FIG. 8, in the case of a friction member 90' of another embodiment, an elongated grooves 96' are vertically formed in the same direction as the inner guide grooves 92' at the outer surface of the friction member 90' so that when an inwardly acting compression force is applied to the friction member 90' via the supporting member 80, the friction member 90' can be more easily deformed and a proper friction force can be generated.

Therefore, since the compression force of the supporting member 80 is concentrated on the projected surfaces 97' at which the elongated grooves 96' of the friction member 90' are not formed, the friction member 90' can be easily deformed and the friction force between the friction member 90' and the suspension rod 60 can be formed.

The operation of the suspension apparatus of a washing machine configured as above according to the present invention will be described as follows.

When the washing machine is operated the washing phase is proceeded as the laundry is agitated by water currents generated in the inner drum 52, and after the washing and rinsing phases, the extraction phase is carried out as the inner drum 52 at high speed.

When the washing machine is in the washing phase or extraction phase, load variations occur due to the movement of the laundry and water therein, and in particular severely eccentric load occurs at the early stage of the extraction phase.

When such severely eccentric load occurs instantaneously, the change of the load is transferred to the damper spring 73 via the outer drum 53 and the supporting member 80, and, at this time, since the supporting member 80 is subject to a compression force between the bracket 53*a* of the outer drum 53 and the damper spring 73, the cutout portion 85 is narrowed and the friction member 90 therein is compressed.

Therefore, since the friction force between the one side friction member 90 and the suspension rod 60 among the four suspension rods 60 supporting the outer drum 53 is increased, and the friction force on the other side friction members 90 and the suspension rods 60 is maintained in a normal state, severe vibrations generated when the outer drum 53 rotates in unbalanced states due to the eccentric load can be minimized.

As described above, the damping force changing means of the present invention can change frictional damping force according to the variation of load and increases the damping force thereof so as to correspond to the inertia of the load when the inertia is large, and therefore the damping force changing means can effectively respond to instantaneous variation of load which occurs during the operation of the washing machine and the generation of vibrations and noises can be suppressed.

The above-described suspension apparatus of a washing machine of the present invention can minimize the generation of vibrations by changing the damping force thereof when eccentric load occurs at the early stage of the extraction phase, and, in addition, can ideally damp the variations in load transferred to the casing of the washing machine via the suspension rods during the normal operation of the washing machine. Therefore, the suspension apparatus provides an advantage in which the generation of noises can be effectively suppressed.

In addition, since, in the suspension apparatus of the present invention, a compression force is maintained by the supporting member even though the friction surfaces between the friction members and the suspension rods are abraded due to the use of the suspension apparatus for a long time, the decrease in a damping force due to the abrasion of the friction surfaces as in the conventional art can be prevented, and the suspension apparatus of the present invention provides an advantage in which excellent damping performance can be maintained for a long time.

The suspension apparatus of the present invention can be adapted in not only the directly coupled motor type washing machine but also all the other types of washing machine.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A suspension apparatus of a washing machine comprising:

suspension rods the upper portions of which are connected to a casing of the washing machine and the lower portions of which are connected to a washing tub so that the washing tub can be supported in the casing in a suspended state;

damper bases installed at the respective lower ends of the suspension rods;

damping force changing means fitted around the respective suspension rods to be movable along the respective suspension rods and positioned above the respective damper bases, so as to be compressed according to the variations in load of the washing tub and change the damping force; and elastic means installed between the damping force changing means and the damper bases, respectively, so as to do buffering action, and, in addition, providing compression forces for the damping force changing means, respectively;

wherein each of the damping force changing means includes a supporting member which has a center hole so as to be fitted around the suspension rod, supports a bracket fixed to the washing tub and is deformed in the inward or outward direction by the compression force provided by the washing tub and the elastic means; and a friction member which is installed in the supporting member and changes the friction force between the friction member and the suspension rod according to the deformation of the supporting member in the inward or outward direction;

wherein the supporting member includes a slopingly surfaced portion and a cutout portion, the slopingly surfaced portion is located between the bracket of the washing tub and the elastic means and is slopingly projected so that when a vertical compression force acts on the supporting member, the supporting member can be deformed in the inward or outward direction, and the cutout portion is formed from the lower end of the supporting portion and to a predetermined height;

wherein the supporting member is formed with the slopingly surfaced portion radially projected, a bracket-fitted portion formed to project in a cylindrical shape at the upside of the slopingly surfaced portion and inserted into the bracket of the washing tub, and a spring-fitted portion which is formed to project in a cylindrical shape at the downside of the slopingly surfaced portion and around which the elastic biasing means is fitted.

2. The suspension apparatus of a washing machine as claimed in claim 1, wherein a frictional-material-inserted portion having a cylindrical bore is formed at the insides of the slopingly surfaced portion and the spring-fitted portion of the supporting member so that the friction member can be inserted into the frictional-material-inserted portion.

3. A suspension apparatus of a washing machine comprising:

suspension rods the upper portions of which are connected to a casing of the washing machine and the lower portions of which are connected to a washing tub so that the washing tub can be supported in the casing in a suspended state;

damper bases installed at the respective lower ends of the suspension rods;

damping force changing means fitted around the respective suspension rods to be movable along the respective suspension rods and positioned above the respective damper bases, so as to be compressed according to the variations in load of the washing tub and change the damping force; and elastic means installed between the damping force changing means and the damper bases, respectively, so as to do buffering action, and, in addition, providing compression forces for the damping force changing means, respectively;

wherein each of the damping force changing means includes a supporting member which has a center hole so as to be fitted around the suspension rod, supports a bracket fixed to the washing tub and is deformed in the inward or outward direction by the compression force provided by the washing tub and the elastic means; and a friction member which is installed in the supporting member and changes the friction force between the friction member and the suspension rod according to the deformation of the supporting member in the inward or outward direction;

wherein the friction member is in a cylindrical shape and is made of rubber, a plurality of guide grooves are vertically formed at the inner surface of the center hole, and a lubricant storing recess is formed at the lower portion of the center hole in a circumferential direction so that injected lubricant can be contained therein.

4. The suspension apparatus of a washing machine as claimed in claim 3, wherein an O-ring portion is formed below the lubricant storing recess by forming the inner diameter thereof to be relatively small so that the lubricant cannot leak.

5. The suspension apparatus of a washing machine as claimed in claim 3, wherein a plurality of projections are formed at the outer surface of the friction member.

6. The suspension apparatus of a washing machine as claimed in claim 3, wherein a plurality of grooves are vertically formed at the outer surface of the friction member.

* * * * *